US006149207A

United States Patent [19]

Bradford, Jr.

[11] Patent Number: 6,149,207

[45] Date of Patent: Nov. 21, 2000

[54] NECKTIE DIMPLING TOOL

[76] Inventor: Barry Delano Bradford, Jr., 1755 Woodbridge La., Boise, Id. 83706

[21] Appl. No.: 09/239,602

[22] Filed: Jan. 29, 1999

[51] Int. Cl.[7] ..... A41D 25/08

[52] U.S. Cl. ..... 289/18.1; 2/152.1; 223/82

[58] Field of Search ..... 2/144, 145, 148, 2/152.1; 289/17, 18.1; 223/81, 82, 83, DIG. 2; 24/3.11, 49.1, 66.3, 66.8, 66.13, 493, 495, 499, 509, 510

[56] References Cited

U.S. PATENT DOCUMENTS

| | | | |
|---|---|---|---|
| 620,677 | 3/1899 | Schuck . | |
| 1,109,283 | 9/1914 | Elmore . | |
| 1,981,740 | 11/1934 | Mix | 24/49 |
| 2,488,414 | 11/1949 | King | 28/72 |
| 2,732,602 | 1/1956 | Quimby | 24/49 |
| 2,908,953 | 10/1959 | Anderson | 24/49 |
| 3,287,042 | 11/1966 | Baer | 289/17 |
| 3,365,755 | 1/1968 | Vastano et al. | 24/49 |
| 3,964,105 | 6/1976 | Gideon | 2/152.1 |
| 4,206,513 | 6/1980 | Collins | 2/152 R |
| 4,542,537 | 9/1985 | Plapp et al. | 2/148 |
| 5,577,778 | 11/1996 | Parietti et al. | 289/17 |

*Primary Examiner*—Michael A. Neas
*Attorney, Agent, or Firm*—Joseph W. Holland

[57] ABSTRACT

A necktie dimpling tool for depressing the area below a knot placed in a necktie forming a generally vertical dimple in the necktie just below the knot including a pair of pivotally attached and opposing ribs arranged so that a compressive force is maintained between the pair of ribs. The tool may also include a third or center rib disposed between the pair of ribs. The center rib may be pivotable in relation to the pair of ribs and may be arranged so that a compressive force is maintained between the center rib and/or both of the pair of pivotally attached and opposing ribs.

16 Claims, 6 Drawing Sheets

NECKTIE DIMPLING TOOL

BACKGROUND OF THE INVENTION

1. Technical Field

The present invention relates generally to neckties and more particularly to devices for depressing the area below a knot placed in the necktie when worn, thereby forming a generally vertical dimple or crease in the necktie just below the knot.

2. Background

A variety of devices for obtaining a visually pleasing effect in the front portion of the necktie extending below a formed knot presenting a dimple in the vertical portion of the necktie are disclosed in the prior art. These devices are configured in a variety of ways including tools that may be inserted between the final overhand or facing pass of the knot and the outer generally vertical leg of the necktie and which are adapted to define an elongated dimple on the necktie just below the formed knot. These tools include a variety of insertable wedges, fingers and sleeves. Generally speaking, these devices are employed after the knot is substantially formed, e.g. U.S. Pat. No. 5,577,778 to Parietti et.al., which requires the user to manipulate both the necktie for purposes of tightening and the device simultaneously to form the dimple. Other devices may actually remain in place after the knot is completed, to be worn with the necktie to maintain the dimple in the necktie, e.g. U.S. Pat. No. 4,542,537 to Plapp et.al. and U.S. Pat. No. 4,206,513 to Collins.

What is needed is a tool which allows the user to obtain the pleasing effect of a generally vertical dimple or crease in the necktie just below the knot on the front portion of a necktie without causing the user to manipulate both the necktie for purposes of tightening and the tool simultaneously to form the dimple or without causing the discomfort of leaving the device embedded within the knot after formation.

SUMMARY OF THE INVENTION

According to the present invention, these and other objects are achieved by a necktie dimpling tool for depressing the area below a knot placed in the necktie when worn, thereby forming a generally vertical dimple or crease in the necktie just below the knot. One embodiment of the necktie dimpling tool includes a pair of pivotally attached and opposing ribs which are arranged and configured such that a compressive force is maintained between the pair of ribs, typically by employing a spring at or near the pivot point between the pair of ribs.

Another embodiment of the invention also includes a center rib having an inner face and an outer face disposed between the inner rib and the outer rib, with a first spring element operatively disposed between the inner rib and the outer rib to maintain a compressive force between the inner rib and the outer rib. Alternately, the necktie dimpling tool may be configured having a first spring element operatively disposed between the inner rib and the center rib and a second spring element operatively disposed between the center rib and the outer rib to maintain a compressive force between the ribs. Additionally, the center rib may be pivotable in relation to the inner rib and the outer rib.

In use, and following substantial completion of the formation of the knot, the inner rib is inserted between the neck of the wearer and the inner pass of the knot. The center rib is inserted between the facing pass of the knot and the outer generally vertical leg of the necktie, and the outer rib extends vertically below the facing pass of the knot. As the knot is tightened, the inner rib, the center rib and the outer rib cooperate to facilitate depression of the center region of the vertical leg of the necktie just below the knot, thereby forming a generally vertical dimple in the necktie just below the knot. Once the dimple is properly formed and the knot is tightened to the extent possible with the necktie dimpling tool in place, the tool is removed. Following removal of the necktie dimpling tool, the knot may be cinched or tightened as desired by the wearer.

An alternate embodiment of the invention includes an outer rib pivotally attached to an opposing inner rib and a first spring element operatively disposed between the inner rib and the outer rib to maintain a compressive force between the inner rib and the outer rib. In use, and following substantial completion of the formation of the knot, the inner rib is inserted between the inner face of the knot and the neck of the wearer and the outer rib is inserted between the last or facing pass of the knot and the vertical leg of the necktie extending vertically below the facing pass of the knot. As the knot is tightened, the inner rib and outer rib cooperate to facilitate depression of the center region of the vertical leg of the necktie just below the knot, thereby forming a generally vertical dimple in the necktie just below the knot. Once the dimple is properly formed and the knot is tightened to the extent possible with the necktie dimpling tool in place, the tool is removed. Following removal of the necktie dimpling tool, the knot may be cinched or tightened as desired by the wearer.

The necktie dimpling tool may be configured so that the outer rib, the inner rib and the center rib each curve slightly along the length of the rib forming a generally concave inner face. This aspect of the invention presents the distal end or tip of the outer rib and the center rib and the inner face of the center rib in such a manner that the center portion of the generally vertical outer face of the tie, just below the knot, is depressed slightly during use facilitating formation of the generally vertical dimple in the necktie just below the knot.

The necktie dimpling tool may be configured so that each of the pair of pivotally attached and opposing ribs curve slightly from a first side edge to a second side edge creating a groove along the length of the inner face of each rib and a corresponding ridge along the inner face of each rib. This feature of the invention facilitates insertion and removal of the necktie dimpling tool between the passes of the knot and the outer generally vertical leg of the tie.

The center rib may be configured having a substantially circular cross-section having a diameter of one quarter of an inch plus or minus three sixteenths of an inch, ($\frac{1}{4}\pm\frac{3}{16}$). This feature of the invention facilitates formation of the dimple. In that embodiment of the invention having only an outer rib and an inner rib, the outer rib may be configured having a substantially circular cross-section having a diameter of one quarter of an inch plus or minus three sixteenths of an inch, ($\frac{1}{4}\pm\frac{3}{16}$). Again, this feature of the invention facilitates formation of the dimple.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

It should be understood that the referenced drawings are not to scale and are intended as representations. The drawings are not necessarily intended to depict the functional and structural details of the invention, which can be determined by one of skill in the art by examination of the descriptions and claims provided herein.

DETAILED DESCRIPTION OF THE INVENTION

Figure 1:
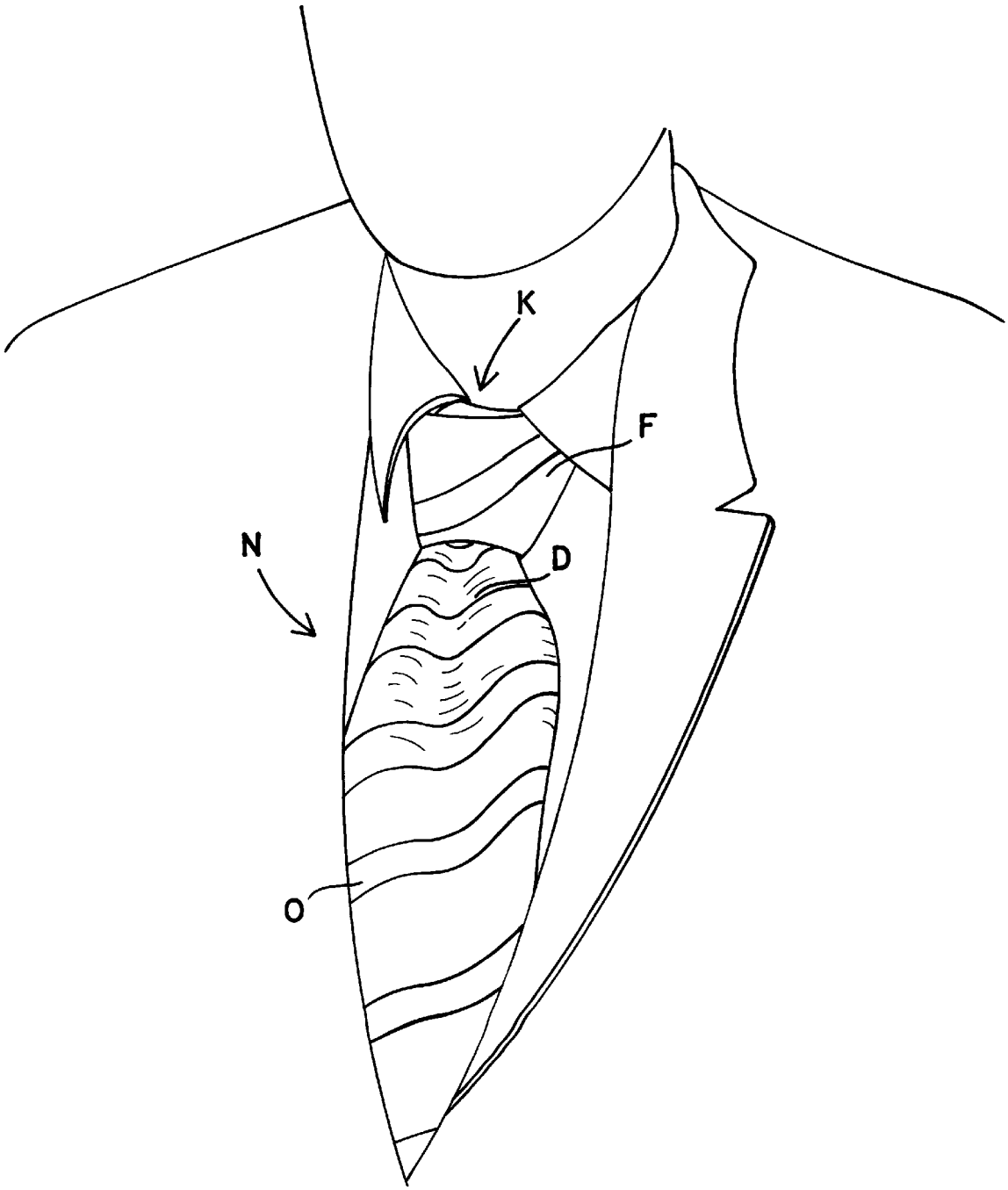
FIG. 1 is a perspective representational view of a necktie including a constricted area below the knot forming a generally vertical dimple or crease in the necktie just below the knot.
Figure 2:
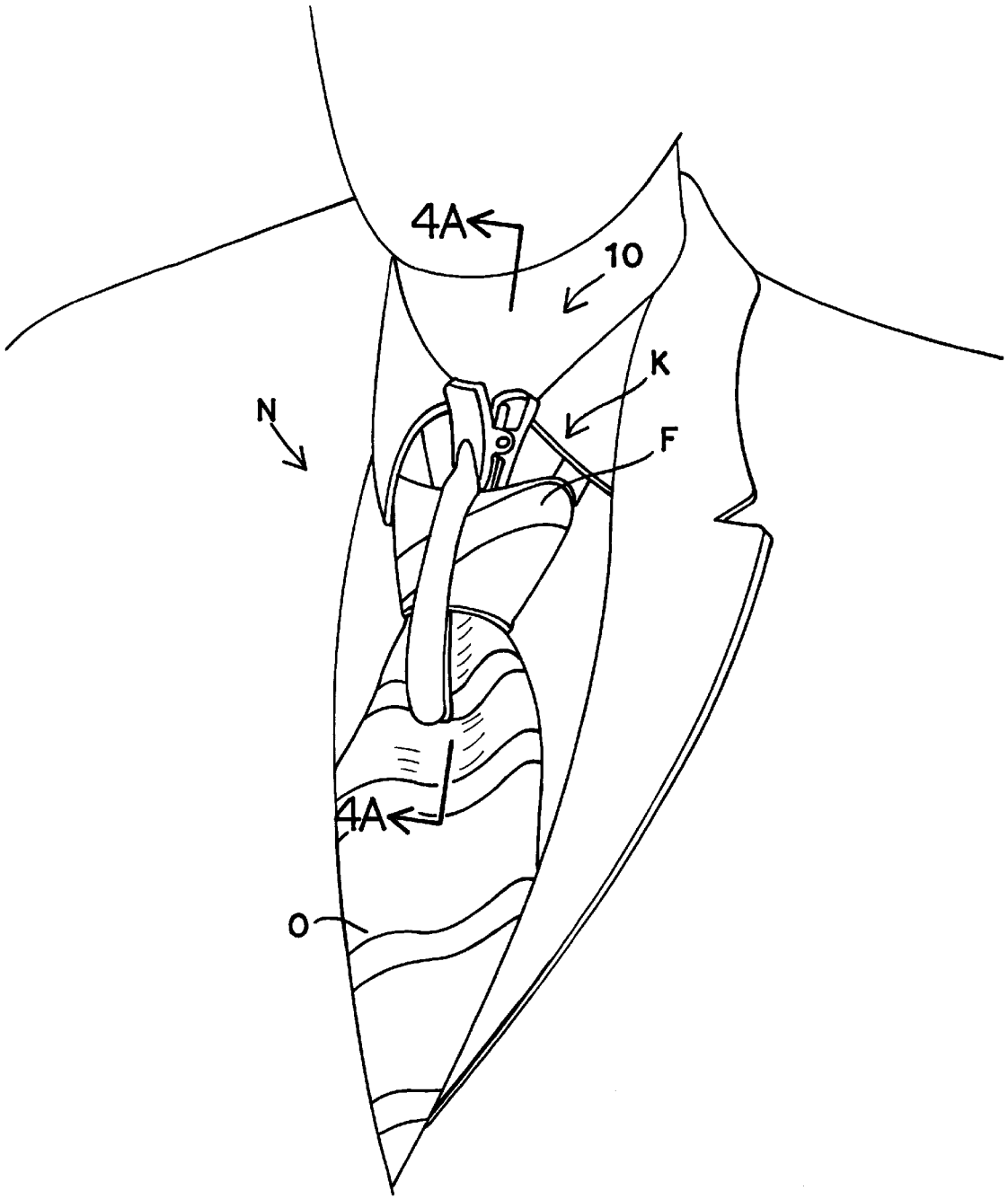
FIG. 2 is a perspective representational view of a necktie illustrating placement of a necktie dimpling tool according to the present invention, employed in tying a knot in a necktie forming a generally vertical dimple or crease in the necktie just below the knot.

Referring to FIGS. 1 and 2, necktie N is shown including knot K which is tied so that outer vertical leg O depends just below facing pass F. Dimple D is shown formed in outer vertical leg O forming a generally vertical depression in outer vertical leg O which produces a pleasing draping effect in the presentation of outer vertical leg O. FIG. 2 illustrates the placement of necktie dimpling tool 10 while employed in forming a dimple in necktie N just below knot K.

Figure 3:
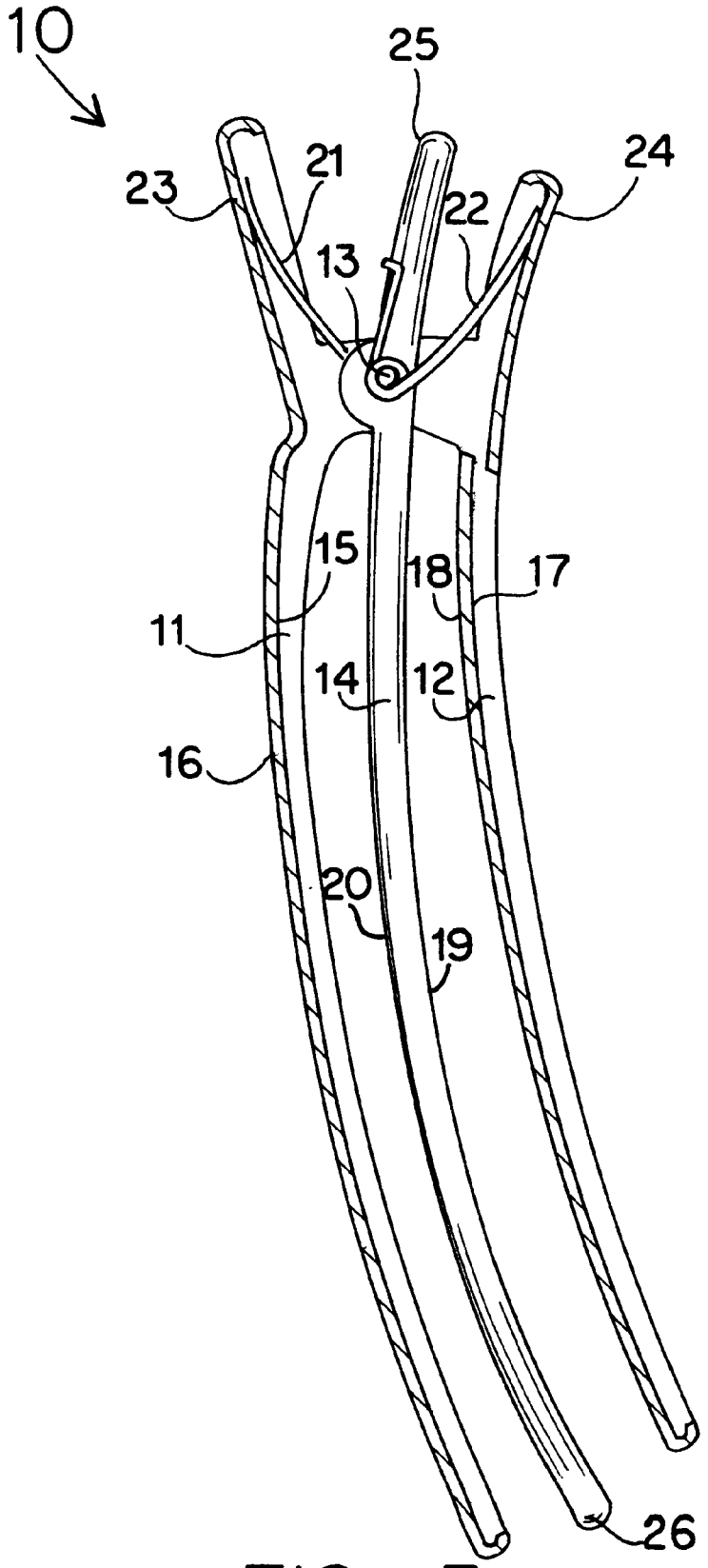
FIG. 3 is a side cross-sectional representational view of a necktie dimpling tool according to the present invention.

Referring to FIG. 3, necktie dimpling tool 10 is shown in a side cross-sectional representational view. In the embodiment of the invention shown in FIG. 3, necktie dimpling tool 10 includes outer rib 11 having outer rib inner face 15 and outer rib outer face 16. Inner rib 12 opposes and is pivotally attached to outer rib 11 at pin 13. Inner rib 12 includes inner rib inner face 17 and inner rib outer face 18. In the embodiment of the invention shown in FIG. 3, necktie dimpling tool 10 also includes center rib 14 having center rib inner face 19, center rib outer face 20 and center rib tip 26. Center rib 14 is also pivotally attached to outer rib 11 and inner rib 12 at pin 13.

FIG. 3 also depicts first spring element 21 disposed between outer rib 11 and center rib 14 for maintaining a compressive force between outer rib 11 and center rib 14. Similarly, second spring element 22 is disposed between center rib 14 and inner rib 12 for maintaining a compressive force between center rib 14 and inner rib 12.

FIG. 3 also shows outer rib compression tab 23 formed at the upper end of outer rib 11 above pin 13. Similarly, inner rib compression tab 24 is formed at the upper end of inner rib 12 above pin 13. Center rib tab 25 extends above pivot pin 13 between outer rib compression tab 23 and inner rib compression tab 24. Outer rib compression tab 23 and inner rib compression tab 24 provide an individual using necktie dimpling tool 10 with a pair of opposing surfaces to grasp for spreading outer rib 11, center rib 14 and inner rib 12 for insertion in and placement over a partially tied knot.

Figure 4A:
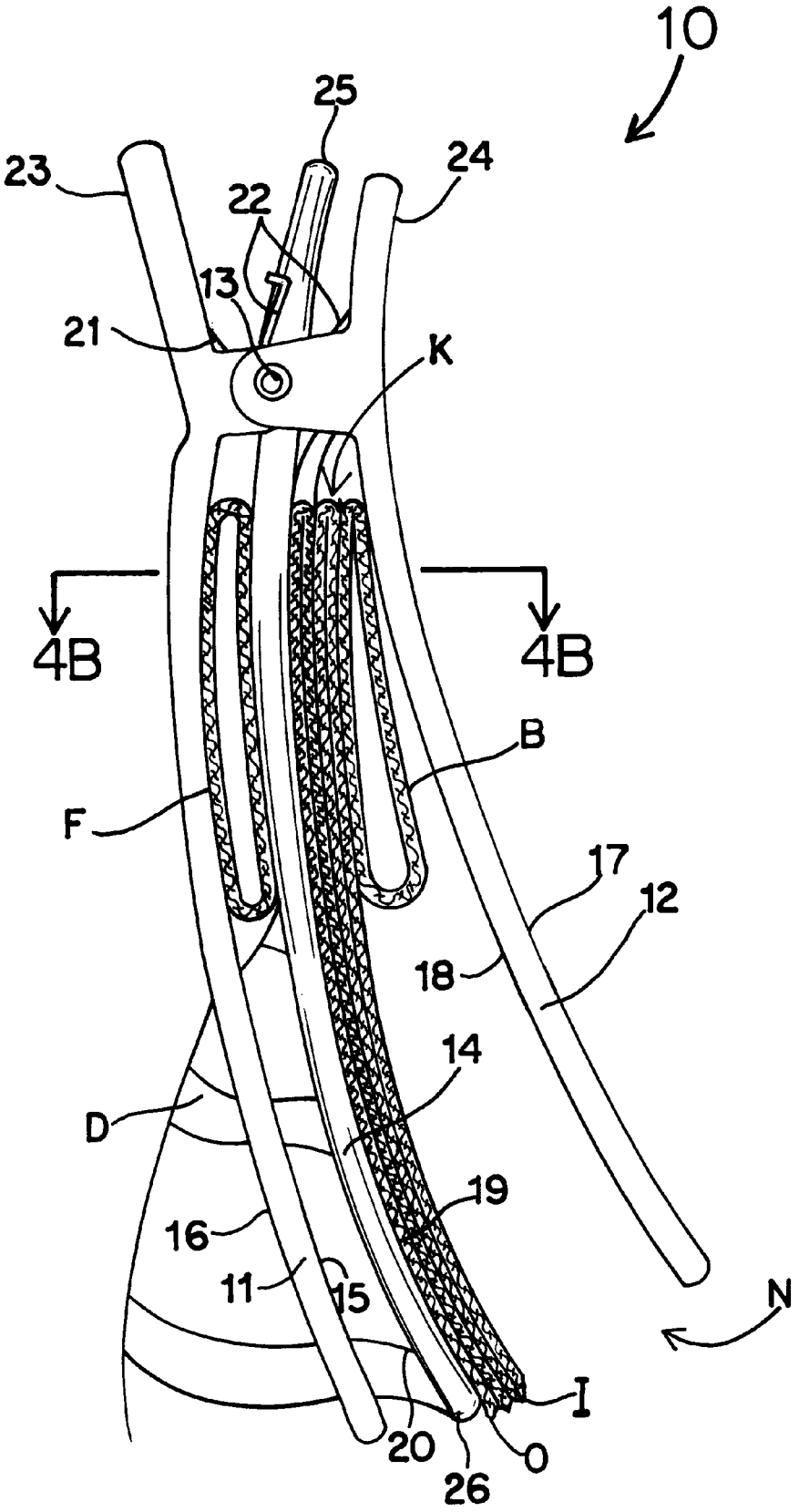
FIG. 4A is side cross-sectional representational view of a necktie illustrating placement of the ribs of a necktie dimpling tool according to the present invention during use.

Referring to FIG. 4A, necktie N is shown including knot K which is tied so that outer vertical leg O depends just below facing pass F. Dimple D is shown formed in outer vertical leg O forming a generally vertical depression in outer vertical leg O. Inner vertical leg I is shown extending from within knot K and depending below inner pass B of knot K. FIG. 4A illustrates a side representational view of necktie dimpling tool 10 in use showing a side cross-sectional representational view of necktie N. FIG. 4A illustrates placement of the ribs of necktie dimpling tool 10 during use.

In the embodiment of the invention shown in FIG. 4A, necktie dimpling tool 10 includes outer rib 11 having outer rib inner face 15 and outer rib outer face 16. Inner rib 12 opposes and is pivotally attached to outer rib 11 at pin 13. Inner rib 12 includes inner rib inner face 17 and inner rib outer face 18. In the embodiment of the invention shown in FIG. 4A, necktie dimpling tool 10 also includes center rib 14 having center rib inner face 19 and center rib outer face 20. Center rib 14 is also pivotally attached to outer rib 11 and inner rib 12 at pin 13.

FIG. 4A illustrates the manner in which necktie dimpling tool 10 is inserted in and placed over knot K. Particularly, inner rib 12 extends behind inner pass B of knot K and inner vertical leg 1. Center rib 14 is inserted between outer vertical leg O and facing pass F of knot K with center rib inner face 19 held compressively against outer vertical leg O. Outer rib 11 extends over and in front of facing pass F of knot K. As knot K is tightened, outer vertical leg O is drawn through knot K between inner vertical leg I and facing pass F of knot K. As knot K tightens, necktie dimpling tool 10, particularly the compressive force exerted on outer vertical leg O by center rib inner face 19, causes a generally vertical dimple D to form in outer vertical leg O as formation of knot K is completed.

Referring to FIG. 4A, necktie N is shown including knot K which is tied so that outer vertical leg O depends just below facing pass F. Dimple D is shown formed in outer vertical leg O forming a generally vertical depression in outer vertical leg O. Inner vertical leg I is shown extending from within knot K and depending below inner pass B of knot K. FIG. 4A illustrates a side representational view of necktie dimpling tool 10 in use showing a side cross-sectional representational view of necktie N. FIG. 4A illustrates placement of the ribs of necktie dimpling tool 10 during use.

In the embodiment of the invention shown in FIG. 4A, necktie dimpling tool 10 includes outer rib 11 having outer rib inner face 15 and outer rib outer face 16. Inner rib 12 opposes and is pivotally attached to outer rib 11 at pin 13. Inner rib 12 includes inner rib inner face 17 and inner rib outer face 18. In the embodiment of the invention shown in FIG. 4A, necktie dimpling tool 10 also includes center rib 14 having center rib inner face 19 and center rib outer face 20. Center rib 14 is also pivotally attached to outer rib 11 and inner rib 12 at pin 13. Necktie dimpling tool 10 is shown configured so that outer rib 11 curves slightly along the length forming a generally concave outer rib inner face 15. Similarly, inner rib 12 curves slightly along its length forming a generally concave inner rib inner face 17. Finally, center rib 14 curves slightly along its length forming a generally concave inner rib center face 19. This aspect of the invention presents center rib tip 26 and inner rib center face 19 in such a manner during use that vertical outer leg O, just below knot K, is depressed slightly as formation of knot K is completed facilitating formation of vertical dimple D.

FIG. 4A also shows outer rib compression tab 23 formed at the upper end of outer rib 11 above pin 13. Similarly, inner rib compression tab 24 is formed at the upper end of inner rib 12 above pin 13. Center rib tab 25 extends above pivot pin 13 between outer rib compression tab 23 and inner rib compression tab 24. Outer rib compression tab 23 and inner rib compression tab 24 provide an individual using necktie dimpling tool 10 with a pair of opposing surfaces to grasp for spreading outer rib 11, center rib 14 and inner rib 12 for insertion in and placement over a partially tied knot.

FIG. 4A illustrates the manner in which necktie dimpling tool 10 is inserted in and placed over knot K. Particularly, inner rib 12 extends behind inner pass B of knot K. Center rib 14 is inserted between outer vertical leg O and facing pass F of knot K with center rib inner face 19 held compressively against outer vertical leg O. Outer rib 11 extends over and in front of facing pass F of knot K. As knot K is tightened, outer vertical leg O is drawn through knot K between inner vertical leg I and facing pass F of knot K. As knot K tightens, necktie dimpling tool 10, particularly the compressive force exerted on outer vertical leg O by center rib inner face 19, causes a generally vertical dimple D to form in outer vertical leg O as formation of knot K is completed.

Figure 4B:
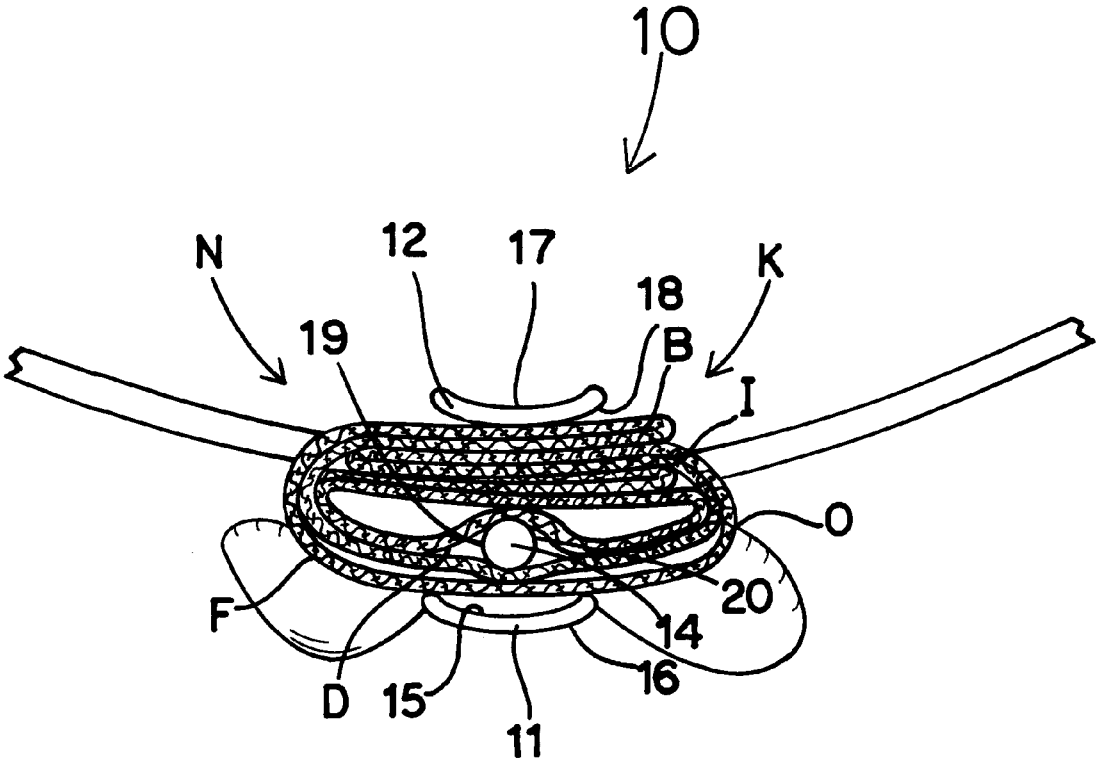
FIG. 4B is top cross-sectional representational view of a necktie illustrating placement of the ribs of a necktie dimpling tool according to the present invention during use.

FIG. 4B is a top cross-sectional representational view of necktie dimpling tool 10 in use showing a cross-sectional representational view of necktie N. Referring to FIG. 4B, necktie N is shown including knot K. Outer vertical leg O is shown passing between facing pass F and inner vertical leg 1. Dimple D is shown formed in outer vertical leg O. Inner vertical leg I is shown extending between outer vertical leg O and inner pass B of knot K. FIG. 4B illustrates placement of the ribs of necktie dimpling tool 10 during use.

In the embodiment of the invention shown in FIG. 4B, necktie dimpling tool 10 includes outer rib 11 having outer rib inner face 15 and outer rib outer face 16. Inner rib 12 opposes outer rib 11 and includes inner rib inner face 17 and inner rib outer face 18. In the embodiment of the invention shown in FIG. 4B, necktie dimpling tool 10 also includes center rib 14 having center rib inner face 19 and center rib outer face 20. Necktie dimpling tool 10 is shown configured so that outer rib 11 curves slightly from side to side forming a groove on outer rib inner face 15. Similarly, inner rib 12 curves slightly from side to side forming a groove on inner rib inner face 17.

FIG. 4B illustrates the manner in which necktie dimpling tool 10 is inserted in and placed over knot K. Particularly, inner rib 12 extends behind inner pass B of knot K and inner vertical leg 1. Center rib 14 is inserted between outer vertical leg O and facing pass F of knot K with center rib inner face 19 held compressively against outer vertical leg O. Outer rib 11 extends over and in front of facing pass F of knot K. As knot K is tightened, outer vertical leg O is drawn through knot K between inner vertical leg I and facing pass F of knot K. As knot K tightens, necktie dimpling tool 10, particularly the compressive force exerted on outer vertical leg O by center rib inner face 19, causes a generally vertical dimple D to form in outer vertical leg O as formation of knot K is completed.

Figure 5:
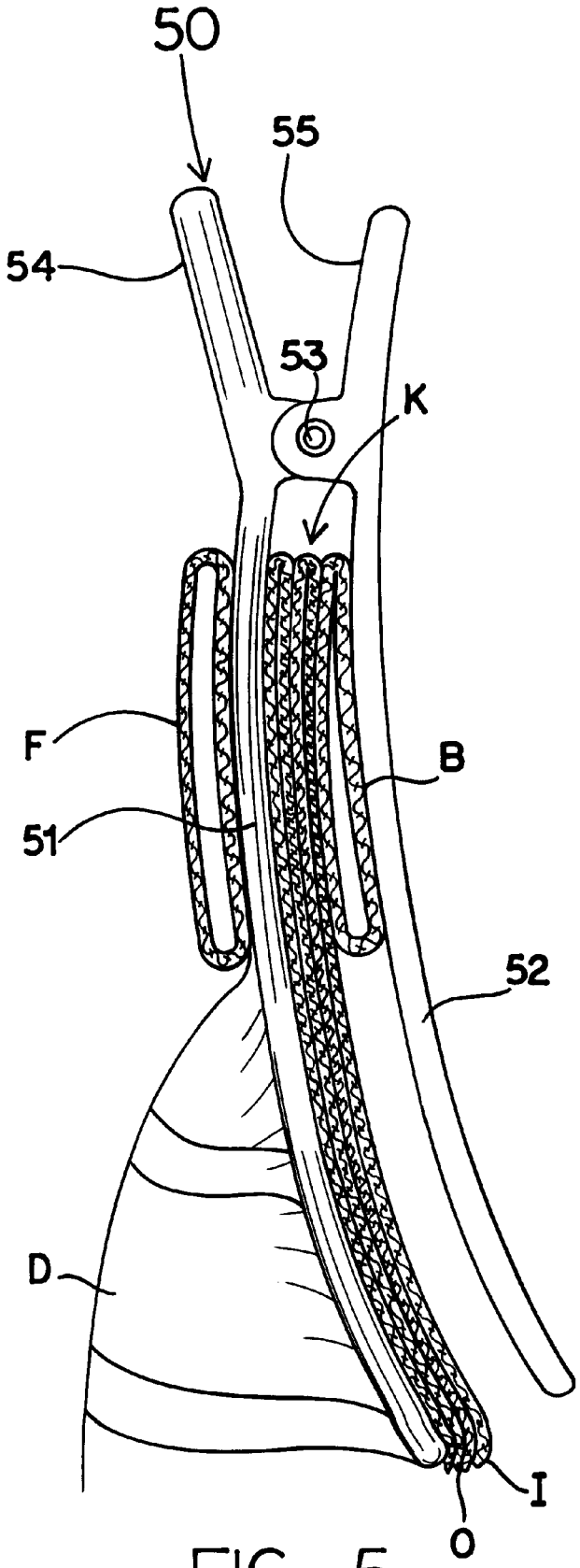
FIG. 5 is side cross-sectional representational view of a necktie illustrating placement of the ribs in an alternate embodiment of a necktie dimpling tool according to the present invention during use.

FIG. 5 illustrates an alternate embodiment of necktie dimpling tool 50 including outer rib 51 and inner rib 52 pivotally attached to and opposing outer rib 52 at pin 53. In the embodiment of the invention shown in FIG. 5, necktie dimpling tool 50 also includes outer rib compression tab 54 and inner rib compression tab 55. Inner rib 52 is shown inserted between inner pass B of the knot K and the neck of the wearer and outer rib 51 is inserted between facing pass F of knot K and outer vertical leg O extending vertically below facing pass F.

FIG. 5 illustrates the manner in which necktie dimpling tool 50 is inserted in and placed over knot K. Particularly, inner rib 52 extends behind inner pass B of knot K. Outer rib 51 is inserted between outer vertical leg O and facing pass F of knot K with outer rib 51 held compressively against outer vertical leg O. As knot K is tightened, outer vertical leg O is drawn through knot K between inner vertical leg I and facing pass F of knot K. As knot K tightens, necktie dimpling tool 50, particularly the compressive force exerted on outer vertical leg O by outer rib 51 and inner rib 52, causes a generally vertical dimple D to form in outer vertical leg O as formation of knot K is completed.

While there is shown and described the preferred embodiment of the invention, it is to be distinctly understood that this invention is not limited thereto but may be variously embodied to practice within the scope of the following claims.

I claim:

1. A necktie dimpling tool for forming a dimple below a knot formed in a necktie comprising:

an outer rib including an inner face and an outer face, the outer rib including a dowel;

an inner rib including an inner face and an outer face, the inner rib pivotally attached to and opposing the outer rib;

a pivot pin pivotally connecting the outer rib to the inner rib at a pivot point;

a first spring element disposed between the inner rib and the outer rib for maintaining a compressive force between the inner rib and the outer rib.

2. The necktie dimpling tool of claim 1 wherein the inner rib further comprises a curve extending along the length of the inner face of the inner rib.

3. The necktie dimpling tool of claim 1 wherein the outer rib further comprises a curve extending along the length of the inner face of the outer rib.

4. The necktie dimpling tool of claim 1 further comprising:

an inner rib compression tab formed at an upper end of the inner rib; and an outer rib compression tab formed at an upper end of the outer rib, the inner rib compression tab and the outer rib compression tab providing a pair of opposing surfaces to grasp for spreading a lower end of outer rib and a lower end of inner rib.

5. A necktie dimpling tool for forming a dimple below a knot formed in a necktie comprising:

an outer rib including an inner face and an outer face, the outer rib including a curve extending along the length of the inner face of the outer rib;

an inner rib including an inner face and an outer face, the inner rib pivotally attached to and opposing the outer rib;

a pivot pin pivotally connecting the outer rib to the inner rib;

a center rib; and a first spring element disposed between the inner rib and the outer rib for maintaining a compressive force between the inner rib and the outer rib.

6. The necktie dimpling tool of claim 5 wherein the center rib is pivotally connected to the pivot pin.

7. The necktie dimpling tool of claim 5 further comprising:

an inner rib compression tab formed at an upper end of the inner rib; and an outer rib compression tab formed at an upper end of the outer rib, the inner rib compression tab and the outer rib compression tab providing a pair of opposing surfaces to grasp for spreading a lower end of outer rib and a lower end of inner rib.

8. The necktie dimpling tool of claim 5 further comprising a center rib tab formed at an upper end of the center rib.

9. The necktie dimpling tool of claim 5 wherein the inner rib further comprises a curved inner face forming a groove along the length of a inner face of the inner rib.

10. The necktie dimpling tool of claim 5 wherein the center rib further comprises a dowel.

11. A necktie dimpling tool for forming a dimple just below a knot formed in a necktie comprising:

an outer rib including an inner face and an outer face;

an inner rib including an inner face and an outer face, the inner rib pivotally attached to and opposing the outer rib, and the inner rib further comprises a curve extending along the length of the inner face of the inner rib;

a pivot pin pivotally connecting the outer rib to the inner rib at a pivot point;

a center rib including an inner face and an outer face, the center rib disposed between the inner rib and the outer rib;

a first spring element disposed between the inner rib and the center rib for maintaining a compressive force between the inner rib and center rib; and a second spring element disposed between the outer rib and the center rib for maintaining a compressive force between the outer rib and the center rib.

12. The necktie dimpling tool of claim 11 wherein the center rib is pivotally connected to the pivot pin.

13. The necktie dimpling tool of claim 11 wherein the outer rib further comprises a curve extending along the length of the inner face of the outer rib.

14. The necktie dimpling tool of claim 11 wherein the center rib further comprises a dowel.

15. The necktie dimpling tool of claim 11 further comprising:

an inner rib compression tab formed at an upper end of the inner rib; and an outer rib compression tab formed at an upper end of the outer rib, the inner rib compression tab and the outer rib compression tab providing a pair of opposing surfaces to grasp for spreading a lower end of outer rib and a lower end of inner rib.

16. The necktie dimpling tool of claim 11 further comprising a center rib tab formed at an upper end of the center rib.

* * * * *